US005901479A

United States Patent [19]

Langdon

[11] Patent Number: 5,901,479

[45] Date of Patent: May 11, 1999

[54] BUCKET FOR A FRONT-END LOADER

[76] Inventor: Dess Langdon, Rte. 3, P.O. Box 160D, Popes Lake Rd., Angier, N.C. 27501

[21] Appl. No.: 08/901,862

[22] Filed: Jul. 29, 1997

[51] Int. Cl.[6] ..... E02F 3/40

[52] U.S. Cl. ..... 37/444; 37/379; 37/903

[58] Field of Search ..... 37/444, 445, 443, 37/379, 380, 908, 903, 398, 442; 414/722, 723; 172/810

[56] References Cited

U.S. PATENT DOCUMENTS

| | | | |
|---|---|---|---|
| Re. 33,198 | 4/1990 | Ballinger | 37/444 |
| 1,208,835 | 12/1916 | Robinson | 37/380 |
| 2,657,481 | 11/1953 | Larsen | 37/444 |
| 2,838,856 | 6/1958 | Buisse | 37/404 |
| 2,972,425 | 2/1961 | Anderson et al. | 37/379 |
| 3,048,292 | 8/1962 | Kohorst et al. | 37/444 X |
| 4,055,262 | 10/1977 | Bauer et al. | 414/697 |
| 4,231,173 | 11/1980 | Davis | 37/457 |
| 4,329,103 | 5/1982 | Miller | 37/403 X |
| 4,561,199 | 12/1985 | Lockwood | 37/403 |
| 4,896,444 | 1/1990 | Sieber et al. | 37/444 |
| 4,903,418 | 2/1990 | Loudon | 37/301 |
| 5,234,282 | 8/1993 | Osborn | 37/403 X |

*Primary Examiner*—Heather Shackelford
*Attorney, Agent, or Firm*—Rhodes, Coats, & Bennett, LLP

[57] ABSTRACT

The present invention relates to a bucket for a front-end loader. The bucket comprises a planer back and an elongated relatively narrow bottom panel that projects from the back. Extending upwardly and outwardly from the bottom panel is a pair of opposed triangular shaped sides. The triangular shaped sides and the bottom panel form a generally V-shaped forwardly converging bucket structure.

16 Claims, 3 Drawing Sheets

BUCKET FOR A FRONT-END LOADER

FIELD OF THE INVENTION

The present invention relates to material handling devices and more particularly to a bucket for a front-end loader.

BACKGROUND OF THE INVENTION

Buckets for front-end loaders are commonplace and are widely used in various areas of construction, grading and excavation. Typically, buckets of the prior art include what might be referred to as a rectangular opening. Generally, conventional bucket designs feature a pair of vertical side walls and a surrounding interconnecting structure that extends from the lower front cutting edge of the bucket back around to a top area. Such conventional buckets are efficient and effective for certain material handling operations. However, conventional bucket designs do not lend themselves particularly to specialty operations such as landscaping. Further, they are not designed for great maneuverability and are generally incapable of digging relatively small and precise openings in the ground.

While it is true that conventional buckets are used by landscapers, it is generally recognized and appreciated by landscapers and those people working in the landscaping industry that conventional bucket designs are not particularly effective and efficient in everyday landscaping operations. For example, it is quite difficult and time consuming to dig a correct size hole for a pre-dug tree with a conventional front-end loader bucket. In addition, there are other landscaping related jobs that cannot be efficiently carried out with a conventional bucket. For example, trenches are typically dug in the ground for the purpose of installing irrigation lines and pipes. Conventional front-end loader buckets are not designed to handle such operations efficiently.

There have been attempts at providing bucket designs that are particularly suitable for landscaping operations. See, for example, U.S. Pat. No. 4,903,418. This patent discloses an elongated concave scoop that is designed to be attached to a front-end loader. This concave scoop design, like a conventional bucket designs, has limited applications. It is not particularly suited for a wide range of landscaping uses and is not suited for light to medium duty grading and excavation. In addition, the fact that the central component of this device entails a concave scoop panel makes the device relatively expensive and difficult to build.

There has been and continues to be a need for a relatively simple and inexpensive bucket design that lends itself to a wide range of landscaping operations and which can also be used in light to medium duty grading and excavation operations.

SUMMARY AND OBJECTS OF THE INVENTION

The present invention entails a bucket design for a front-end loader that is simple in design, relatively inexpensive, and overcomes the drawbacks and disadvantages of prior art bucket designs. The bucket design of the present invention comprises a back and a forwardly projecting bottom panel. The bottom panel is elongated and relatively narrow. Extending generally upwardly and outwardly from opposed sides of the bottom panel is a pair of generally triangular shaped sides. These triangular shaped sides along with the back and bottom panel form a bucket structure that is of a forwardly converging generally V-shaped configuration. The resulting bucket design can be provided with one or more hook structures that help facilitate the lifting and transport of pre-dug trees from a truck or trailer to a hole that has been dug by the bucket.

It is therefore an object of the present invention to provide a relatively inexpensive bucket design that is suitable for use with a front-end loader and is particularly adapted for use in general landscaping operations.

Another object of the present invention is to provide a front-end loader bucket that is designed to dig precise holes for pre-dug trees and also is adapted to transport the pre-dug trees from a transport device to the actual location of the planting site.

A further object of the present invention resides in the provision of a bucket design that can be fabricated from generally planer steel stock and does not require curved, convex, or concave bucket sections.

Still a further object of the present invention is to provide a bucket design that is highly maneuverable and which can be effectively used in confined and tight areas.

Other objects and advantages of the present invention will become apparent and obvious from a study of the following description and the accompanying drawings which are merely illustrative of such invention.

DETAILED DESCRIPTION OF THE INVENTION

Figure 1:
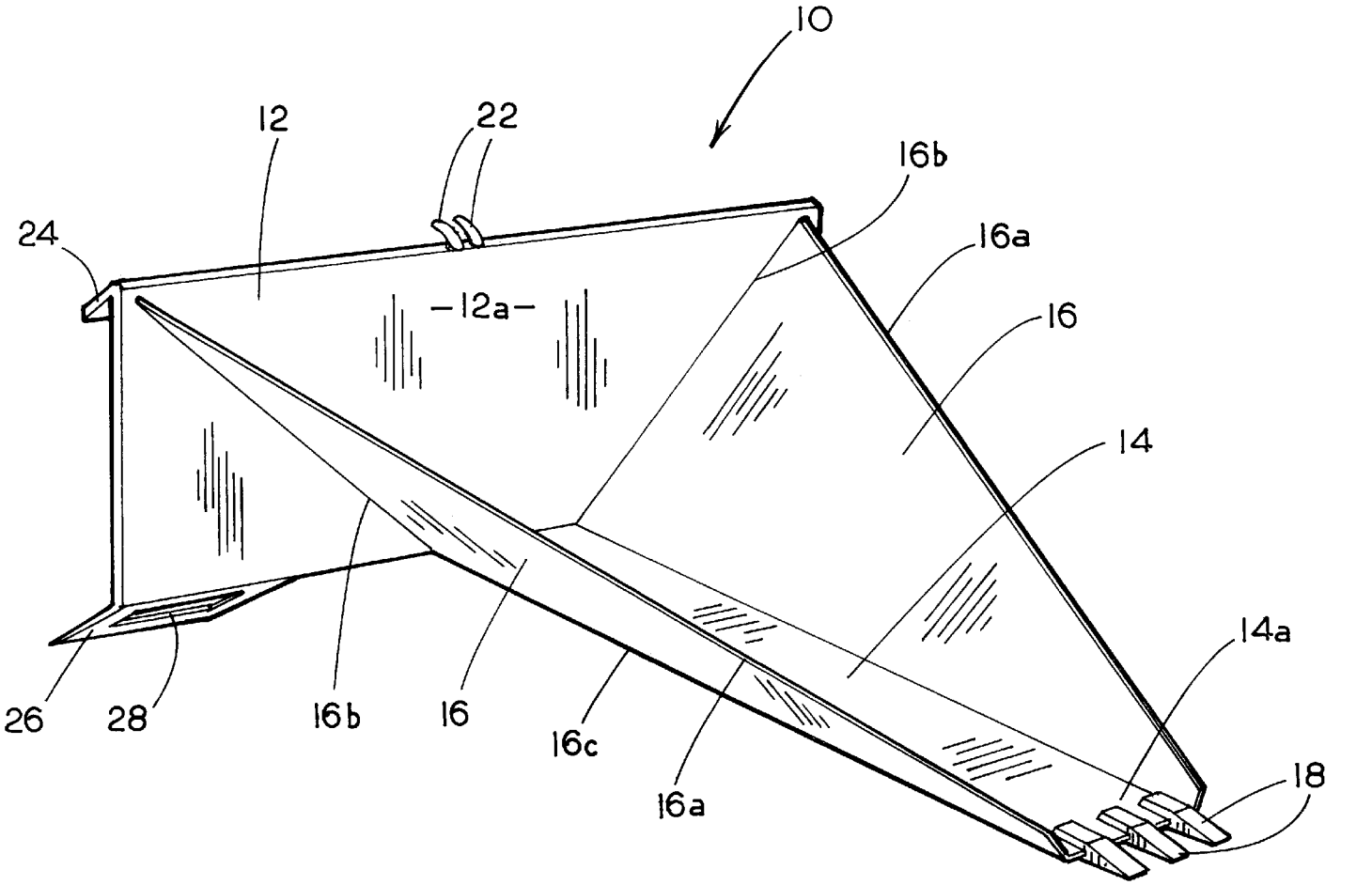
FIG. 1 is a perspective view of the bucket of the present invention.
Figure 2:
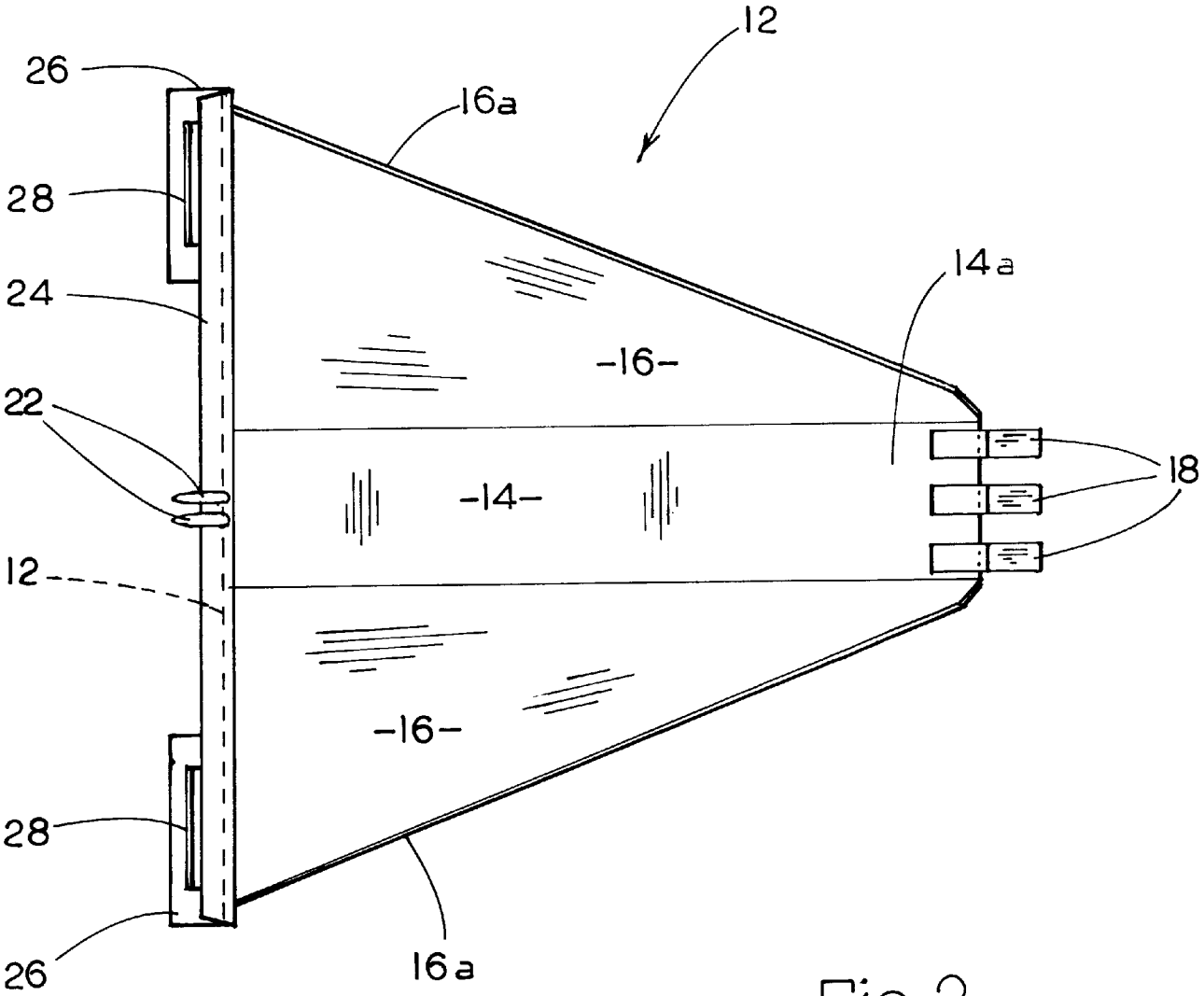
FIG. 2 is a top plan view of the bucket.
Figure 4:
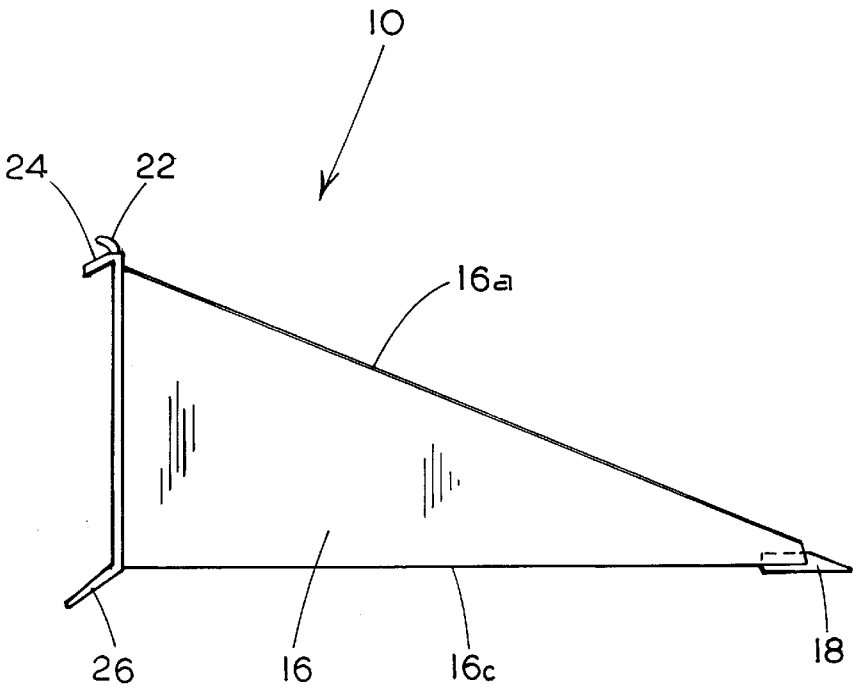
FIG. 4 is a side elevational view of the bucket.
Figure 3:
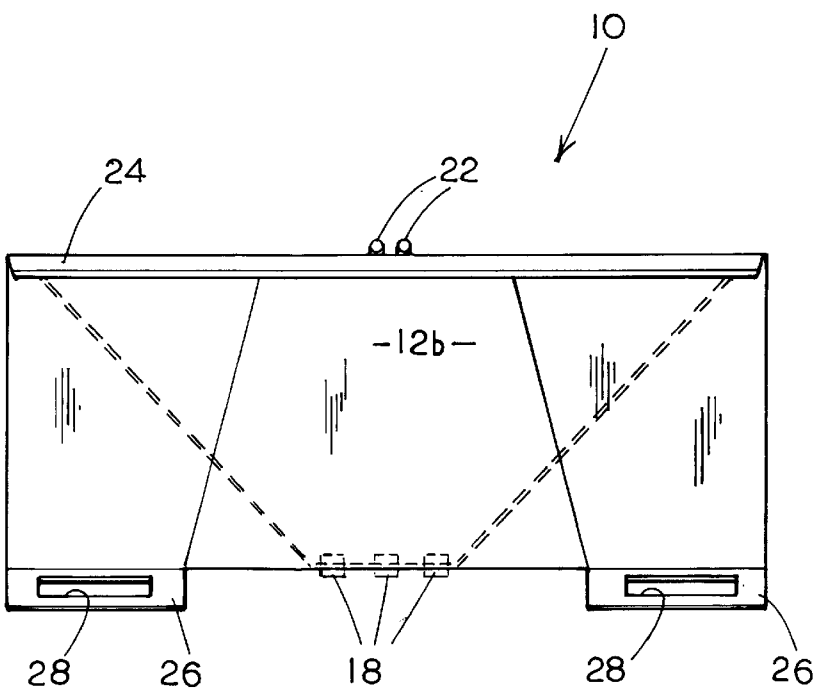
FIG. 3 is a rear elevational view of the bucket.

With further reference to the drawings, the bucket of the present invention is shown therein and indicated generally by the numeral 10. As will be appreciated from subsequent portions of this disclosure, bucket 10 is adapted to be mounted to a front-end loader. There are many commercially available front-end loaders and it is to be understood that the bucket 10 of the present invention could be adapted to be mounted to all such commercial front-end loaders.

Viewing bucket 10 in more detail, it is seen that the same includes a back 12. The back 12 is in the form of a planer plate structure and includes a front face 12*a* and a rear face 12*b*.

Connected by weldment or other suitable means to the back 12 is a cantilevered bottom panel 14. Bottom panel 14 projects forwardly from the front face 12*a* of the back 12. As seen in the drawings, the bottom panel 14 is an elongated relatively narrow member. Although the width of the bottom panel 14 may vary, in one particular design the width of the bottom panel 14 is approximately 8 inches.

Secured on opposite sides of the bottom panel 14 is a pair of sides 16. Each side 16 is of a general triangular shape. In this regard, note that each side 16 includes an upper inclined edge 16*a*, a back edge 16*b*, and a lower edge 16*c*. The lower edge 16*c* is secured directly to an adjacent edge of the bottom panel 14. The back edge 16*b* is secured, again by weldment or other suitable means, to the back 12 of the bucket. As seen in the drawings, each of the sides 16 is oriented such that they extend generally upwardly and outwardly from the bottom panel 14. This yields a bucket design that is open at the top but generally converges forwardly towards the front end portion, referred to by numeral 14*a*, of the bottom panel 14. Thus, the bottom panel 14 along with the two sides 16 form a generally converging V-shaped cross-section.

Secured to the front end portion 14*a* of the bottom panel 14 is a series of hardened digging teeth 18. The teeth 18 project forwardly past the forward terminal portions of the bottom panel 14 and the sides 16.

Secured to the upper edge of the back 12 is at least one chain hook indicated by the numeral 22. Chain hook 22 is utilized to secure a chain to the bucket 10 for the purpose of lifting and transporting pre-dug trees and the like. For example, a chain can be connected to the hook 22 and channeled downwardly along the bottom plate 14 and between respective digging teeth 18. There the chain simple drapes downwardly and by utilizing a hook on the terminal end of the chain, the wrapped ball portion of a pre-dug tree can be engaged with the hook. Thereafter, the lifting of the bucket 10 will result in the chain lifting the pre-dug tree and essentially suspending the pre-dug tree from the chain and the bucket. This enables the front-end loader operator to lift and transport pre-dug trees and other objects from one area to another area.

Secured to the upper edge of the back 12 is a chain hook indicated by the numeral 22. Chain hook 22 is utilized to secure a chain to the bucket 10 for the purpose of lifting and transporting pre-dug trees and like objects.

As discussed above, the bucket 10 can be adapted to mount to any conventional front-end loader. In the case of the embodiment illustrated herein, the bucket 10 is shown with an attaching structure that enables it to be mounted to a conventional quick-attach mounting plate (not shown) that includes an upper angled wedge and a series of locking pins. In order to accommodate such an attaching structure, there is provided a top angle hook 24 that extends transversely across the top portion of the back 12. Note that top angle hook 24 projects rearwardly from the rear face 12*b* of the back 12 and is angled at least slightly downwardly relatively to the plane of the back 12. Disposed about the lower portion of the back 12 is a pair of pin hole tabs 26. Pin hole tabs 26 are laterally spaced apart and each includes a hole or opening 28. The hole 28 formed in the tabs 26 are designed to receive a locking pin carried by the attaching member (not shown) of the front-end loader.

More particularly, in order to attach the bucket 10 to a conventional front-end loader, the angled upper edge of an attaching member is inserted underneath the top angle hook 24 and then a pair of pins carried by the attaching member is inserted from the attaching member downwardly through the holes 28 in the pin hole tabs 26. This securely stations the attaching member of the front-end loader to the bucket 10. It should be pointed out, that in order to attach the bucket 10 to the attaching member of the front-end loader, that the operator of the loader will angle the attaching member such that its upper angled edge can be inserted into the top angle hook 34 that extends across the back 12 of the bucket. Thereafter, the operator will rotate the attaching member of the front-end loader to where it is flush against the rear face 12*b* of the back. At this time, the locking pins carried by the attaching member can be inserted downwardly through the holes 28 formed in the pin hole tabs 26.

To release the attaching member from the bucket 10, the front-end loader operator simply removes the locking pins from the hole 28 and then tilts the attaching member such that its upper angled wedge portion is removed from the top angled hook 24.

The size and capacity of the bucket 10 may vary depending upon the expected or anticipated uses of the bucket. In one embodiment, the bucket 10 includes a capacity of approximately one-half cubic yard. In such a design, the back 12 would have a width of approximately 48 inches while the forward length or projection of the bottom panel 14 and sides 16 would be approximately 43 inches. The width of the bottom panel in this case would be approximately 8 inches while the width of a respective side 16 at a point approximately one-third of its distance from the back 12 would be approximately 21½ inches. The materials used to construct the bucket 10 of the present invention may vary also but in a preferred embodiment, the components and structure of the bucket 10 can be made from one-half inch tempered steel.

The bucket 10 of the present invention has many advantages over conventional front-end loader bucket designs. In the present case, the bucket 10 is specifically designed for a wide range of landscaping operations. For example, the bucket 10 can be utilized to move and transport pre-dug trees. In addition, the same bucket 10 can be utilized to dig precise holes in the ground for pre-dug trees and can be utilized to transport the pre-dug trees to the hole previously dug by the bucket 10. In addition, the bucket 10 can be utilized to dig and clean trenches that have been dug for the purpose of laying irrigation pipe. Beyond landscaping duty, the bucket 10 can be utilized in other light to medium duty grading and excavation work. It is particularly useful and efficient in close and tight areas such as areas adjacent building structures.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A bucket adapted to be connected to a front-end loader, comprising:

a) a back having a forwardly facing flat surface;

b) an elongated relatively narrow and generally flat bottom panel secured to the back and projecting forwardly therefrom and including a forward end portion, the back and bottom panel being secured together at a generally right angle;

c) a pair of flat side panels disposed on opposite sides of the bottom panel and connected to both the bottom panel and the back; and wherein each side panel is approximately two to three times wider than the bottom panel at its maximum width;

d) each side panel being angled with respect to the bottom panel such that it extends generally upwardly and outwardly from the bottom panel;

e) each side panel including an upper angled edge that extends generally downwardly from the back to the forward end portion of the bottom panel so as to form a side retaining structure along the length of the bottom panel, and wherein the back, bottom panel and opposed sides form an open top bucket structure that is open from the back to the forward end portion of the bottom panel;

f) a series of digging teeth projecting forwardly from the forward end portion of the bottom panel; and g) a mounting structure formed on the back for connecting the bucket to a front-end loader.

2. The bucket of claim 1 including a chain hook secured to the back of the bucket.

3. The bucket of claim 2 wherein the chain hook is secured to a top edge of the back.

4. The bucket of claim 1 including an attaching angle and a pair of laterally spaced pin hole tabs that project generally rearwardly from the back of the bucket.

5. The bucket of claim 1 wherein each side panel conforms to a generally triangular shape.

6. The bucket of claim 1 wherein the width of the bucket becomes progressively narrower from the back towards the front-end portion of the bottom panel.

7. The bucket of claim 1 wherein the width of the side panel decreases from the back of the bucket towards the front of the bucket.

8. A bucket for a front-end loader comprising: a back; an elongated relatively narrow bottom panel secured at a generally right angle to the back and projecting forwardly therefrom; the bottom panel being generally flat and less then ½ the width of the back; a pair of generally triangular shaped flat sides secured on opposite sides of the bottom panel to both the bottom panel and the back, each generally triangularly shaped side extending upwardly and outwardly from the bottom panel and extending substantially the entire length of the bottom panel, and wherein each side includes an upper edge that extends generally downwardly from the back to a forward end portion of the bottom panel to form a forwardly converging bucket, and wherein the back, bottom panel, and the opposed sides form a bucket structure that is open at the top from the back to a front terminal portion of the bucket.

9. The bucket of claim 8 including a series of digging teeth that project forwardly from the bucket.

10. The bucket of claim 8 wherein the width of each side becomes progressively narrower towards the forward end of the bucket.

11. The bucket of claim 8 wherein the bottom panel and pair of sides form a generally V-shaped bucket configuration.

12. The bucket of claim 8 including at least one chain hook that enables a chain to be secured to the bucket for lifting and raising and generally handling objects such as pre-dug trees.

13. The front-end loader of claim 1 wherein each side panel lies in a single plane and wherein the upper edge of each side panel forms the upper boundary of the side panel.

14. The front-end loader of claim 13 wherein each side panel is of a triangular shape.

15. The front-end loader of claim 14 wherein the back includes a pair of upper corners and wherein the side panels are disposed with respect to the back such that each side panel projects towards one of the upper corners of the back.

16. The front-end loader of claim 15 wherein the side panels and the bottom panel form a part of the bucket structure and wherein the side panels converge from the back towards the forward end portion of the side panels.

* * * * *